United States Patent [19]

Yun

[11] 4,442,873

[45] Apr. 17, 1984

[54] CONTAINER ACTUATED COUNTERPRESSURE FILLING VALVE

[75] Inventor: Chung J. Yun, Baltimore, Md.

[73] Assignee: Crown Cork & Seal Company, Inc., Philadelphia, Pa.

[21] Appl. No.: 325,289

[22] Filed: Nov. 27, 1981

[51] Int. Cl.[3] ..... B67C 3/06

[52] U.S. Cl. ..... 141/39; 141/46; 141/57; 141/183; 141/302

[58] Field of Search ..... 141/37, 39–66, 141/129–198, 285–310, 250–284, 98, 94–96, 199–229, 1, 4–8

[56] References Cited

U.S. PATENT DOCUMENTS

| | | | |
|---|---|---|---|
| 2,663,479 | 12/1953 | D'etrgz | 141/149 |
| 3,090,408 | 5/1963 | Naecker | 141/57 |
| 3,478,785 | 11/1969 | Mallrich et al. | 141/39 |
| 3,834,428 | 9/1974 | Rademacher | 141/149 |
| 4,089,353 | 5/1978 | Antonelli | 141/302 |

FOREIGN PATENT DOCUMENTS 777929 7/1957 United Kingdom .

*Primary Examiner*—Houston S. Bell, Jr.

*Attorney, Agent, or Firm*—Woodcock, Washburn, Kurtz, Mackiewicz & Norris

[57] ABSTRACT

An improved liquid filling valve for filling containers with carbonated liquid such as soft drinks is disclosed which features concentric valves for introduction of counterpressure gas and product into the container. The container is moved into sealing engagement with the valve which movement is continued to open the valve for admission of counterpressure gas. After counterpressurization is completed the valve for admission of product opens automatically allowing product to fill the container. After filling is completed, motion of the container away from the valve automatically closes it. In the bottle filling embodiment, motion of the bottle away from the valve additionally uncovers a snift port. The counterpressure filling and snifting of containers with carbonated liquids is thus accomplished without use of external valve operating cams or the like.

21 Claims, 8 Drawing Figures

CONTAINER ACTUATED COUNTERPRESSURE FILLING VALVE

FIELD OF THE INVENTION

This invention relates to the field of filling containers such as bottles and cans with carbonated liquids such as soft drinks. More particularly, the invention relates to an improved machine and method for filling such containers, and, still more particularly, to an improved filling valve for use in such machinery.

BACKGROUND OF THE INVENTION

It has long been a need of the art to provide machinery and methods for the rapid, economical and efficient filling of containers such as bottles or cans with carbonated liquids. It will be appreciated that such carbonated liquids present problems in filling as they must be filled under pressure in order that the carbonation cannot escape from the liquid during the filling operation. The carbonation must then be securely contained in the can by an immediately affixed end or, in a bottle, by a cap of either the screw-on or crimped-on type, the latter being referred to hereinafter as a "crown".

Machinery and methods for the filling of containers with carbonated liquids have generally evolved into counterpressure filling machines in which the container is first filled with a gas under pressure, e.g., $CO_2$ at 40 psi; thereafter the carbonated liquid is admitted to the bottle. Since the bottle is already under pressure, the carbonation does not escape, and if the container is closed very quickly thereafter, the carbonation is retained in the liquid. However, prior art valves and machinery for the filling of bottles and cans with carbonated liquids have been more complex and bulky than is desirable and, accordingly, a need continues in the art for improvement on such machines. For example, a filling valve use in a carbonated liquid bottling machine is shown in U.S. Pat. No. 4,089,353 to Antonelli. In that patent, a filling valve is shown which connects a bottle to be filled with a tank containing a supply of liquid with which the bottle is to be filled, and of the pressurized gas for counterpressurizing. The valve is controlled by cam means communicating with the outside of the tank for actuation such that the gas is first admitted to the bottle. The bottle is filled with the counterpressurizing gas until the pressures of the gas and the liquid is equal. A second valve is then opened allowing the liquid to flow into the bottle under the influence of gravity. When the bottle is filled the cam actuator closes the valve and the bottle is lowered away from the valve in a sequenced operation. The pressure in the neck of the bottle is then controllably released by a so-called "snift" valve and the bottle quickly capped or crowned.

While the filling valve of the Antonelli reference is useful and has been a success, nevertheless it would be desirable to further improve it. For example, the Antonelli valve in a presently popular embodiment stands sufficiently tall within the tank containing the counterpressurizing gas and the product with which the bottle is to be filled must be more than six inches deep. Accordingly, if filling machinery using these valves is sold in this country the tank is classified as a pressure vessel and must be very heavily constructed in order to meet applicable code specifications.

Accordingly, it is an object of the invention to provide a filling machine which does not require a tank of dimensions sufficiently great to be classed as a pressure vessel.

The Antonelli valve also requires an actuator external to the tank for controlling the flow of gas and thereafter of product into the bottle to be filled. See also U.S. Pat. No. 3,090,408 to Naecker.

It is an object of the invention to avoid such mechanical actuators of the valve. U.K. Patent 777,929 to Snelling controls the two valves by relative motion of the bottle with respect to the valve, thus avoiding mechanical actuators in the tank, as in Antonelli. However, Snelling still requires plural carefully controlled movements of the bottle. It would be desirable to avoid all such critical mechanical steps. Furthermore the Snelling design is of a valve too tall to fit within a non-pressure vessel sized product tank.

The Antonelli reference requires a cam to actuate the snift valve to release the pressure within the neck of the bottle after filling.

It is an object of the present invention to avoid both the snift valve and the accompanying actuator. The Snelling valve does so, but is unduly complex, as mentioned above.

The Antonelli patent places the gas and the product within the same chamber. Therefore, in order to clean the valve it must be removed from the machine as there is no way to reliably flow a detergent and water solution through all parts of the valve.

While prior art references show separate supplies of gas and product, e.g. in U.S. Pat. No. 3,478,785 to Millrich, it remains an object of the invention to provide a filling valve which can be cleaned in place.

The Antonelli valve rotates with the bottle and product tank and is controlled by a stationary actuator, so that it is operated in accordance with its position with respect to the actuator and opens, releasing product, regardless of whether or not there is a bottle in place under the valve when it is opened. Accordingly, if a bottle should break or for some reason not be present under the valve, product is lost.

It is an object of the invention to provide a valve in which absence or breakage of a container automatically prevents the valve from opening so as to preserve product. Again Snelling appears to fulfill this object, but adds undue complexity.

It is a further general object of the invention to provide a less expensive filling valve and bottle filling machine.

A further object of the invention is to provide a valve filling machine which is capable of higher speed operation than possible in the prior art.

A further object of the invention is to provide a bottle filling machine in which there are provided no external cam actuators which require some overlap of cycle timing sequences thus necessitating slower operation.

An ultimate object of the invention is to provide improved filling machine performance at reduced cost.

SUMMARY OF THE INVENTION

The present invention satisfies the abovementioned needs of the art and objects of the invention, as well as others which will be apparent to those skilled in the art, by its provision of a filling valve which is entirely actuated by the raising of a container, for example a bottle, to engage a lower surface of the valve. Upon raising of the bottle into contact with a seal a first valve is opened admitting counterpressure gas into the bottle. When the pressure of the gas within the bottle is substantially equal to that of the product with which the bottle is to be filled, a second valve automatically opens—i.e., without cam actuators, further movement of the bottle, or the like—allowing product to flow into the bottle. Upon the level of the product in the bottle reaching a vent hole, product filling stops. After a period of time has passed (which need not be precisely controlled with respect to the filling of the bottle), the bottle is lowered away from the filling valve. The product valve closes first; as the bottle drops further away from the valve, product trapped in the neck of the bottle is permitted to fill the bottle to its desired level. In the case of bottles, as the bottle drops further, a snift port is uncovered merely by the action of the valve allowing any pressure remaining in the neck of the bottle to be released to the atmosphere, without the necessity of a cam actuated, carefully sequenced snift valve. The bottle can thereafter be capped or crowned as the case may be by conventional methods. The improved filling valve of the invention has applicability to the filling of both bottles and cans. In the can embodiment the volume of the air space above the product in the can is sufficiently increased before the product in the can is exposed to atmosphere that no snift valve is even required.

BRIEF DESCRIPTION OF THE DRAWINGS

The invention will be better understood if reference is made to the accompanying drawings in which:

FIGS. 4A through 4C, shows the sequence of operations of a filling valve for filling bottles according to the invention; and FIG. 5, comprising

DESCRIPTION OF THE PREFERRED EMBODIMENTS

As noted above the present invention relates to filling of containers with carbonated liquids. The invention is applicable to both filling of cans and bottles. However, as will be understood by those skilled in the art there are detail differences in the machinery used to fill cans and bottles, due obviously to their differing configurations, and also to the distance between the liquid level and the top of the can or bottle. In general, the following description is applicable to the filling of both cans and bottles; where significant differences appear, they are explained. Those skilled in the art will recognize that there are other nonessential distinctions not specifically mentioned as well.

Figure 1:
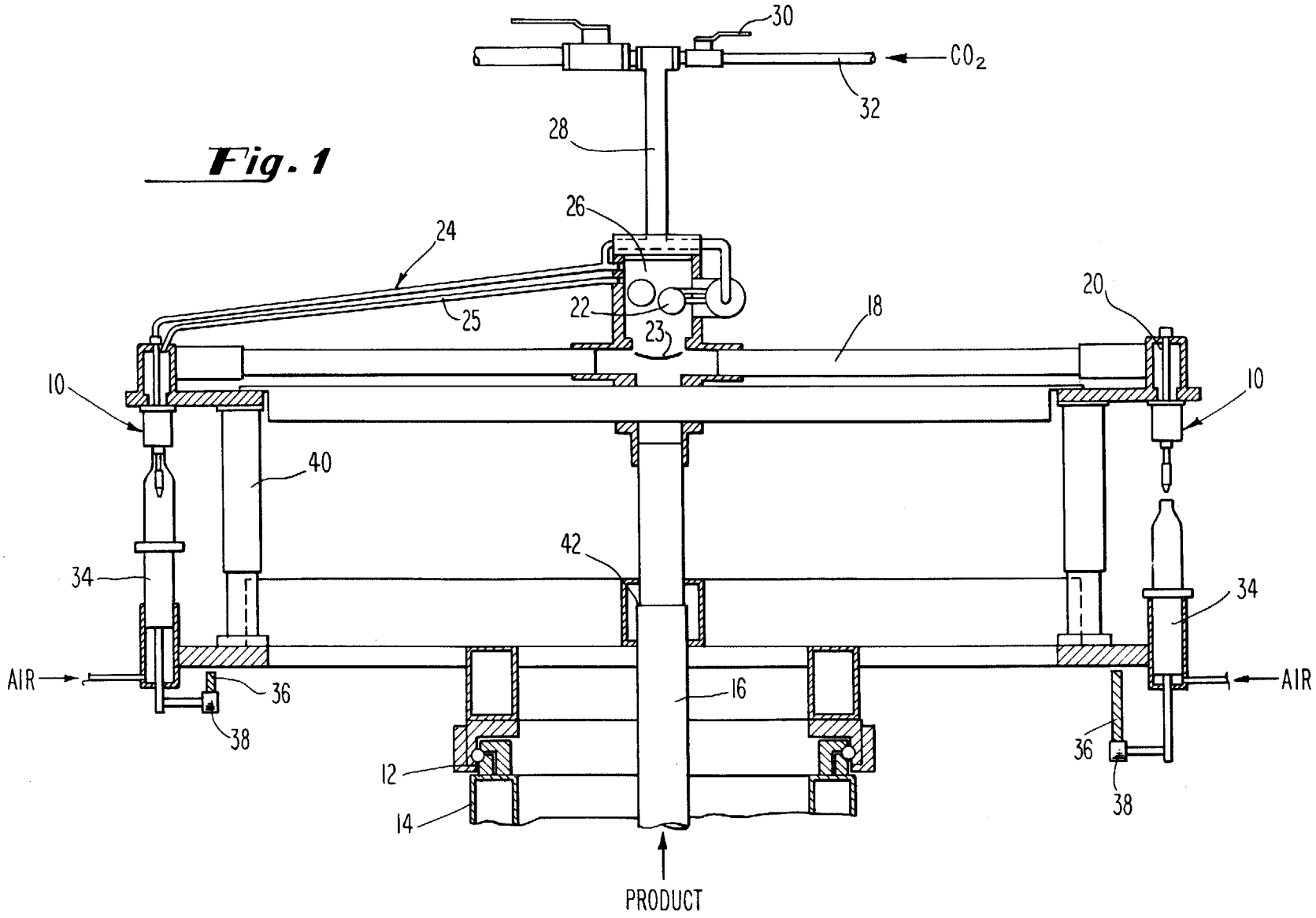
FIG. 1 represents a cross-sectional view of salient portions of machinery embodying the invention.

FIG. 1 shows a cross-sectional view of a machine for filling containers with carbonated liquids. Broadly stated, the machine comprises a circular array of filling valves 10 mounted to a frame journaled for rotation upon bearings 12 with respect to a stationary frame 14. The product with which the containers are to be filled is supplied through a central tube 16 and passes outwardly to the filling valves by means of one or more tubes 18 which are connected to a rotating circular manifold 20 interconnecting all of the filling valves 10. The level of the product (not shown) within tubes 18 and manifold 20 is controlled by conventional float valves 22. A baffle 23 prevents surging in the float chamber.

The counterpressure gas, typically carbon dioxide at 40 psi, for example, is supplied to the filling valves 10 through tubes 24. The $CO_2$ gas is supplied to a central chamber 26 through a tube 28 controlled by a valve 30 connected to a $CO_2$ inlet tube 32.

Around the outside of the container filling machine of the invention are disposed a plurality of air operated pneumatic cylinders 34 which serve to raise and lower the bottles into engagement with the filling valve 10. These also rotate with the manifold 20 and filling valves 10. The air cylinders may in a preferred embodiment all be connected to an air manifold at substantially constant pressure. The actual motion of the containers into engagement with the filling valves 10 is controlled by, e.g., a stationary circular cam 36 against which ride cam rollers 38 operatively connected to the pistons of the pneumatic cylinders 34, such that the relative radial position of the cylinders 34 with respect to the stationary cam 36 controls the height of the bottle with respect to the filling valves 10.

It will be appreciated by those skilled in the art that it is desirable that a container filling machine be adaptable to operate with a wide variety of differing containers which vary not only as to volume but also as to height. In the present invention such compensation is provided by adjustment of elevating spacer pieces 40 which are changed to compensate for the heights of various bottles. The product supply tube 16 telescopes about a telescopic joint 42 in order to enable relative adjustment of the upper portion of the filling machine with respect to the lower. With respect to the variation in volume of various containers to be filled, small variations are accomplished without adjustment insofar as the control of the amount of product inserted into containers is controlled automatically as will be detailed in further detail below. If gross variations in container volume are encountered, such as with 48 oz. soft drink bottles, their filling can be controlled in the same manner, although some slowing of the overall speed of operation of the container filling machine may be necessary to provide enough time for such large bottles to be filled.

Figure 2:
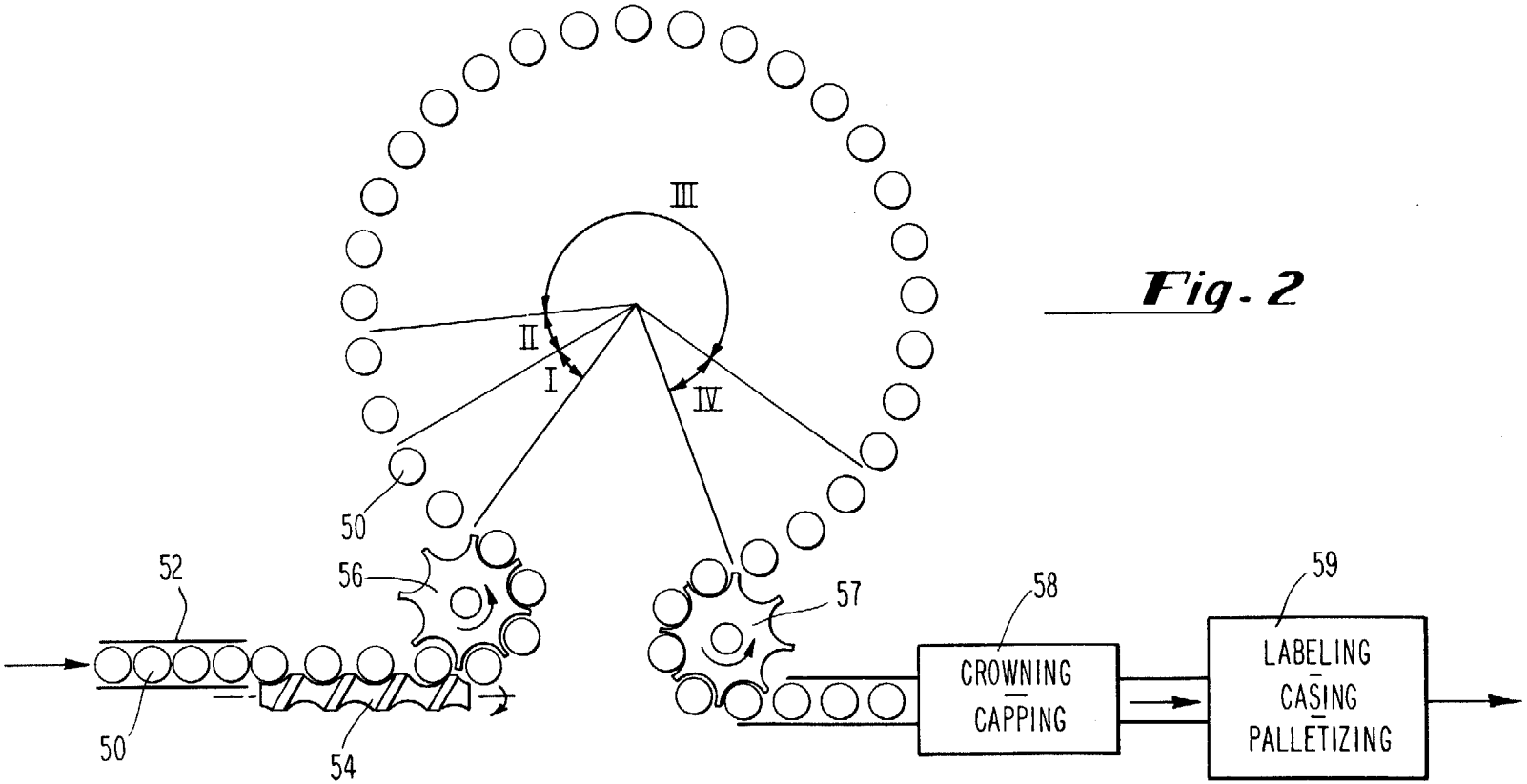
FIG. 2 represents a schematic plan view of the outline of a machine embodying the invention.

FIG. 2 shows a schematic plan view of the filling machine of the invention. Containers 50 to be filled are supplied along a conveyor 52, e.g., at the left of the machine. A conventional worm infeed screw 54 operates in conjunction with conventional starwheels 56 to properly index the containers 50 to be filled onto platforms supported by the individual air cylinders 34 of FIG. 1. The containers 50 to be filled then travel around a circular path underneath the individual filling valves and are filled. It will be noted that FIG. 2 shows the division of the total circular path into five segments labeled I, II, III, and IV and a fifth unlabeled area. The four numbered areas refer to various stages in the cycle of container filling. Specifically, area I represents the portion of the total rotation during which engagement of the bottle with the filling valve takes place; area II represents counterpressurization; area III represents filling; and area IV represents lowering of the bottle with respect to the filling valve, during which the snift operation takes place, in the case of bottles. During the unlabeled region, there is no container 50 disposed on the platform of the air cylinder 34. After having been filled, and after having undergone the snift operation in the case of bottles, they are moved by a second starwheel 57 and supplied to conventional crowning or capping operations indicated generally at 58 and can be labeled, cased and palletized, as indicated at 59.

It will be appreciated that according to the prior art, even in the case of the Snelling British patent referred to above, the sequence of operations, particularly the counterpressure and filling operations were controlled by the operation of cams. Typically, each filling valve comprised an actuator which as the filling machine rotated was moved by contact with a fixed actuator. So that such operations could each be fully completed in their proper sequence before the next begins, it was always necessary to allow more time than should theoretically have been required for the operation to be performed, in order to allow for mechanical variations and the like. Thus, while it might only take 15° of machine rotation to counterpressurize a container, typically the successive actuators would be spaced 25° apart in order to allow full counterpressurization in a worst-case situation, thus allowing for manufacturing tolerances, timing variations and the like. According to the present invention, once a container has been raised into contact with a filling valve, the counterpressurizations and filling operations take place automatically without need of actuators, cams or the like. For example, in Snelling, valve actuators disposed above each valve and operated by stationing members, as in Antonelli, are avoided in favor of progressively bringing the bottle and valve relatively closer together. This too requires very careful timing. According to the present invention, there is no need for cycle-timing compensation to be made to permit operating despite manufacturing tolerances in the manufacture of such cams and the like, so that the sequence of operations of the machine of the invention can be performed at a much higher rate without increasing the various pressures involved, or the like. Similarly, in the Antonelli prior art bottle filling methods a cam was required to actuate a snift valve to release the pressure in the neck of the bottle. According to the present invention, and as in Snelling, the snift operation is performed simply by uncovering of a snift vent during the lowering of the bottle away from the filling valve. Accordingly, much less time need be alloted for this operation, thus again rendering the machine capable of higher speed operation. Moreover, of course, the snift valves and their actuators are similarly eliminated thus greatly lowering the cost of the machine and rendering it more reliable in service as containing less moving parts.

Figure 3:
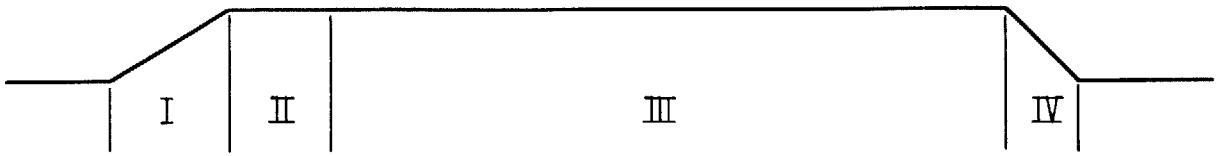
FIG. 3 shows a timing diagram of the sequence of raising and lowering containers to engage with filling valves according to the invention.
Figure 4:
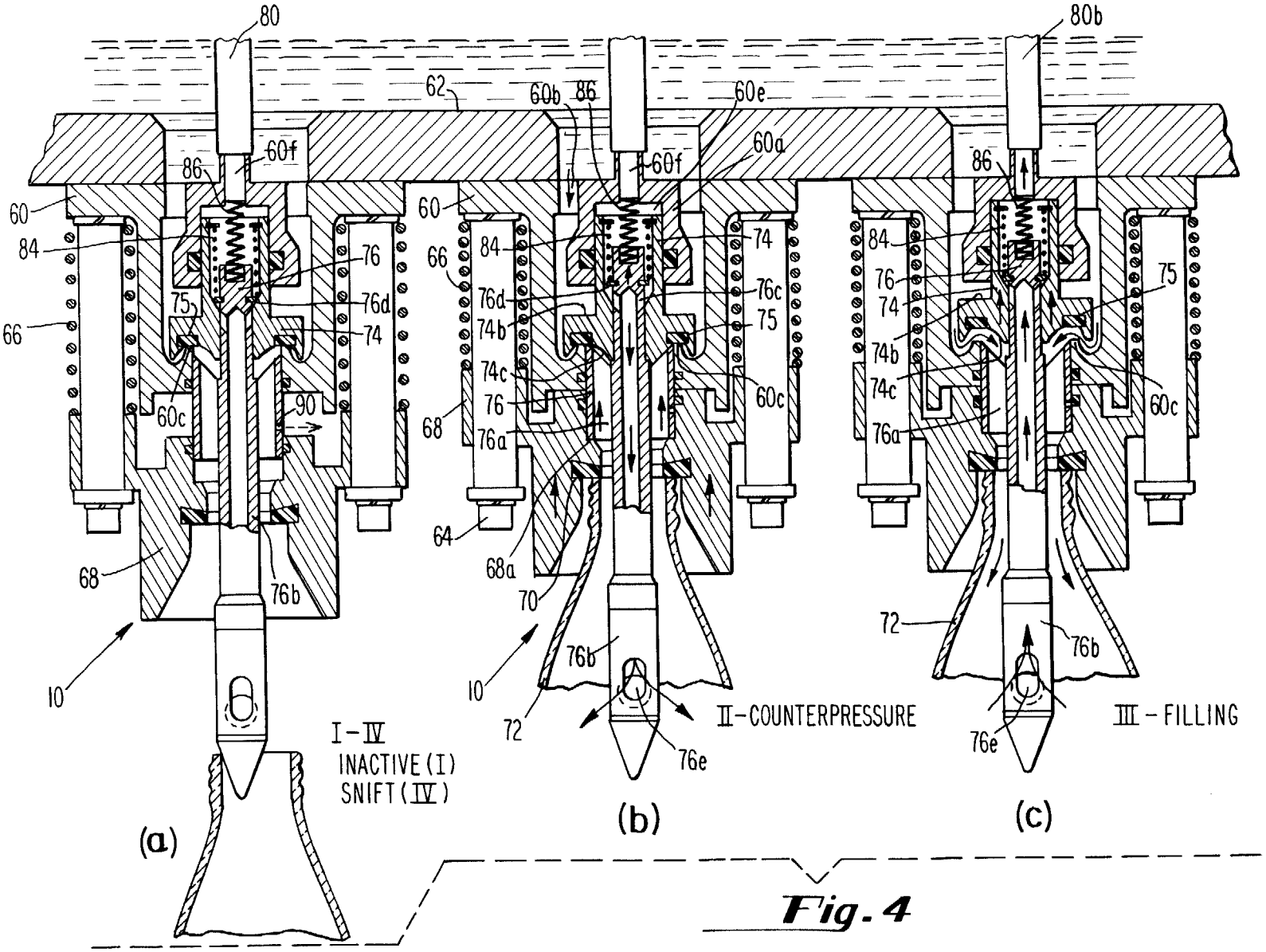
FIG. 4, comprising

FIGS. 4A through 4C show the bottle valve operating stages in the bottle filling cycle according to the method of the invention. FIG. 4A shows the valve prior to the bottle being raised, i.e., in the inactive portion I of the cycle shown in FIGS. 2 and 3. The valve takes the same position during the snift portion IV. FIG. 4B shows stage II, the counterpressurization stage and FIG. 4C shows stage III, during which filling takes place.

Reference will now be made to FIG. 4B for a broad description of the valve of the invention after which a sequential description of the steps in its operation will be described.

The valve, indicated generally at 10, comprises a fixed valve body member 60 which may be affixed directly to the plate 62 forming the bottom of the tank in which the product, i.e., the liquid with which the bottle is to be filled, is contained. The valve body 60 is held to the plate by cap screws 64 concentric with first compression springs 66; one end of each spring abuts the fixed portion 60 of the valve while the other abuts a slidable first actuator portion 68, sliding on cap screws 64; antifriction bushings may be interposed therebetween. Valve actuator member 68 contains a sealing rubber 70 sized to coact with the mouth of a bottle 72 when the bottle is raised with respect to the valve 10 by the cam 36 of FIG. 1. The valve body 60 also comprises a central portion **60*a* which may be formed integrally with the outer portion of the valve body 60 and separated therefrom by an annulus of product passage holes 60*b* drilled in a ring pattern around the upper surface of the valve 60. The valve body 60 together with central portion 60*a* may be made up of several assembled pieces, as is also true of other of the valve parts, for reasons of manufacturing and assembly convenience; the view shown is selected for clarity. A recess 60*e* is formed in the inner portion 60*a* of the fixed valve body member 60, within which slides a movable product valve member 74, which carries a circular product sealing gasket member 75 adapted to mate with a sealing surface 60*c* on the body 60 of the valve 10. When, as described below, the valve member 74 is lifted vertically, the gasket surface 75 leaves the mating surface 60*c* permitting product to flow through the annular ring of holes 60B and down into the bottle 72. The product also passes in its path into the bottle 72 through a plurality of holes 76*a* formed in an annular ring about a movable counterpressure valve member 76 which also comprises a vent tube 76*b* extending into the bottle. The upper end of the counterpressure valve member 76*b* also comprises an annular array of holes 76*c* through which gas can flow when counterpressure sealing member 76*d* is moved away from the first movable product valve member 74, permitting counterpressure gas to flow annularly down through an orifice 60*f* formed in the center of the valve body 60, through the first plurality of holes 76*c* in the vent tube, down the center of the vent tube 76*b*** and out into the bottle.

The sequence of operation of the valve of the invention will now be described in detail. As noted above, FIG. 4A is common to stages I, the inactive stage, during which the bottle is being raised, and stage IV, the snift stage. It will accordingly be described before and after the bottle has been filled. Referring now to FIG. 4A, the valve of the invention 10 is shown confining product at a sealing surface **60*c* of a fixed valve body member 60 which mates with a gasket member 75 carried by a movable product valve portion 74. Similarly, the counterpressurizing gas supplied through a tube 80 and an orifice 60*f* formed in the valve body 60 is confined by a sealing means 76*d* carried by a second movable valve member 76, which also comprises the vent tube 76*b* which extends into the bottle. At this point the three springs which bias the movement of the various valve members, spring 66 which controls movement of the first movable portion 60, spring 84 which controls the motion of the product valve member 74 and spring 86 which controls the motion of the counterpressure valve member 76** are all under only assembly or preload tension; that is, they are arranged to bias all valves closed.

In FIG. 4B the bottle 72 is shown having sealingly engaged the sealing rubber 70 and having pushed the movable valve portion 68 upwardly compressing spring 66. The movable portion 68 comprises a surface **68*a* which engages the counterpressure valve member 76** which causes it and therefore counterpressure sealing means 76d to move upwardly, permitting gas to flow through the orifice 60f, through the orifices 76c and down into the bottle 72 through the vent tube portion 76b thus counterpressurizing the bottle. It will be appreciated that as the counterpressure valve portion 76 is to move upwardly without opening of the product valve portion 74, i.e., to allow counterpressurization of the bottle 72 before product begins to flow, despite compression of spring 84 therebetween, the pressure of the product on the first valve member 74—specifically at surfaces 74b—must be greater than the oppositely directed force exerted by the spring 84 after compression by elevation of counterpressurization valve member 76, which otherwise would tend to elevate the valve member 74 and permit product to flow. Instead, when the force exerted by the counterpressure in the bottle 72 on the undersurfaces 74c of the valve member 74, is substantially equal to that exerted by the product on the upper surface 74b of the valve member 74—i.e., when counterpressurization is completed—spring 84 is permitted to raise the valve member 74, permitting product to flow past sealing gasket 75 and engaging surface 60c, through orifices 76a, and into the bottle, as shown in FIG. 4C. At the same time counterpressurizing gas flows out of the bottle 72 and up the vent tube 76b.

Thus, when the bottle 72 is initially pushed into the valve 10 the springs 86 and 84 are both compressed but the fluid pressure keeps product valve 74 closed until counterpressurization of the bottle is complete.

Stated differently, the balance of pressure between the counterpressure in the bottle and the fluid pressure controls when the product valve 74 opens, and is a function of the relative areas of the top of the valve 74b and its bottom 74c, the relative pressures of gas and product, and the pressure exerted by spring 84 after having been compressed upon the opening of the counterpressure valve 76. Thus, as used hereinafter, terms such as "substantial equality of pressure", i.e., referring to counterpressure gas and the product on the product valve 74, are to be interpreted to include all these factors.

Product continues to flow into the bottle 72 until it reaches the level of the vent hole 76e formed in the vent tube 76b. Since no further counterpressurizing gas can be forced upwardly through the vent tube 76b, flow is compelled to stop. This can occur at any time in the bottle's rotation around the machine of the invention, simply as a function of the level of the product in the bottle.

The bottle and the valve continue to rotate around the machine until the cam 36 (FIG. 1) permits the bottle 72 to drop away from the valve 10. At this point the configuration of the valve of the invention becomes again as in FIG. 4A. As the bottle is lowered the valve members 74 and 76 drop together under the influence of springs 84 and 86. Compressed gas in the "trap" area between the annular gasket member 75 and the mating surface 60c prevent any more product from falling through the annular holes 76A while the springs 84 and 86 are closing both valves 74 and 76 simultaneously. The product remaining in the annular area around the vent tube portion 76e after filling stops flows into the bottle 72 when the bottle 72 and the movable valve portion 68 are being lowered away from the stationary portion 60, thus compensating for the volume of the bottle lost to the vent tube 76b during the filling operation while not wasting product.

As the bottle 72 drops further away from the valve 10, the movable valve member 68 follows along with the bottle until it reaches the rest position shown in FIG. 4A at which time the seal between the mouth of the bottle 72 and the gasket surface 70 is broken. As in the case of the Snelling valve, the volume of the sealed region comprising the head space of the bottle and the interior of the valve up to gasket 75 increases with the dropping of the member 68 together with the bottle 72, being sealed by sealing rubber 70, so that less snift is required than in prior art such as the Antonelli patent referred to above where there was no equivalent increase of the sealed head space volume after filling. Therefore, according to the present invention, the snift operation can be carried out simply by exposure of a snift port 90 (FIG. 4A) to atmospheric pressure, uncovered as valve member 68 moves, rather than requiring a carefully designed valve and sequenced actuator as in the prior art.

Figure 5A:
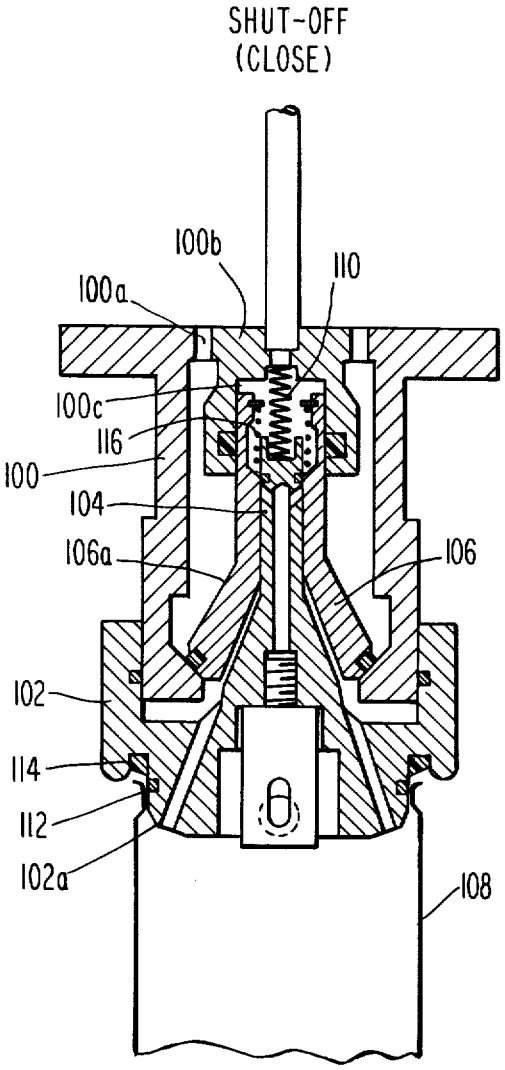
FIGS. 5A and 5B, shows corresponding views of the filling valve for filling cans according to the invention.
Figure 5B:
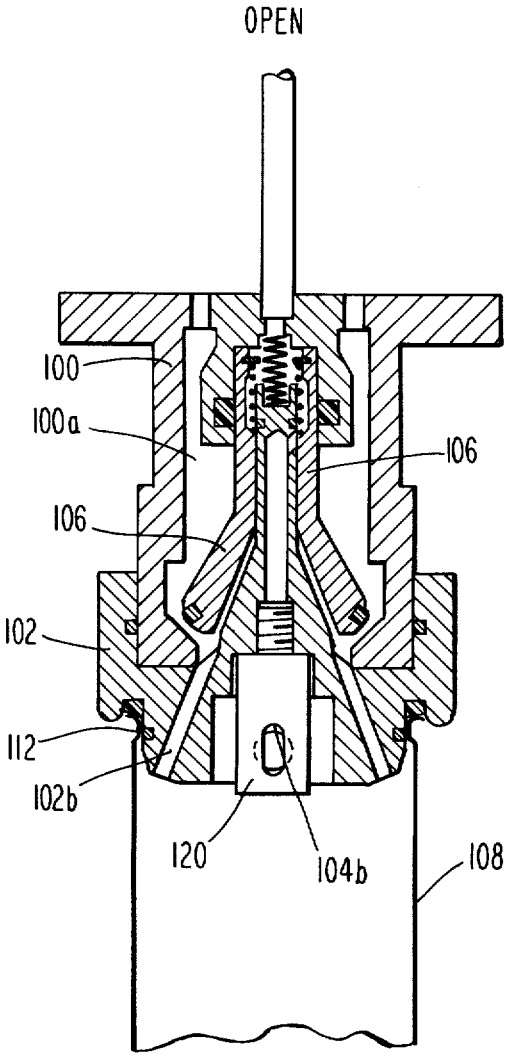

FIGS. 5A and 5B show corresponding views of the counterpressure filling valve of the invention in an embodiment suitable for filling conventional cans. FIG. 5A shows the valve closed position which as in the case of the bottle filling valve of FIGS. 4A through 4C is common to the valve closed position as well as the snift position while FIG. 5B shows the valve in the product filling position. The intermediate position, during which the can is counterpressurized, is not shown for purposes of simplicity, but will be explained in general terms.

Referring now to FIG. 5A, the can filling valve as does the bottle filling valve, comprises a stationary portion 100, a first movable valve body member 102, a counterpressure filling valve 104, which may be formed integrally with the first valve member 102, as shown, and a product filling valve 106. The stationary portion 100 contains central portion 100b defined by an annular ring of orifices 100a and has a recess 100c formed therein in which slides the product valve 106 which in turn carries the counterpressure valve 104. For ease of assembly and manufacture the fixed member 100 can be made in several portions as desired. A can 108 is shown in close conjunction to the movable portion 102 which is controlled by an internal spring 110. The movable portion 102 is desirably made of a plastic material and is the only part which needs to be substituted in order to allow changing of can neck sizes. The movable portion 102 is formed with a rounded or chamfered area 102a which serves as a can guide so as to properly center the can 108 on the movable portion 102. When the can is raised into contact with the movable portion 102 its mouth makes sealing engagement with an O-ring 112 and a second gasket member 114. The O-ring 112 contacts a portion of the can of invariant diameter, so that relative movement therebetween is possible while the seal is maintained. Further lifting of the can 108 opens the counterpressure valve 104 with respect to the product valve 106 as in the case of the bottle filling valve described above in connection with FIGS. 4A through 4C. Again, while a spring 116 which controls the motion of the product valve 106 is compressed upon the lifting of the counterpressure valve 104, the product valve 106 remains closed by the pressure of the product on its outer surface 106a until such time as the force exerted on the product valve 106 by the counterpressure within the can is substantially equal to that exerted on its outside surface 106a by the product, at which time the spring 116 opens the product valve 106, moving it to the position shown in FIG. 5B. At this time, the product flows down around the product valve 106 and through orifices 102b formed in the movable portion 102 permitting the can to be filled. As filling continues, the counterpressure gas leaves the can 108 through a central orifice 104b in the counterpressure valve 104, until the level of the product reaches sufficiently high to close a ball check valve 120 carried by the movable portion 102. When this ball valve closes counterpressure gas can no longer be expelled from the can 108 and filling stops. When the can traverses further around the overall machine, the cam supporting the can allows it to drop away at which time the counterpressure and product valves, 104 and 106 respectively, close simultaneously. The can 108 continues to drop away but remains in sealing engagement with O-ring 112 at its mouth while it moves an appreciable distance, during which time the volume of gas in the head space of the can is increased without exposure to the atmosphere such that no snift port or valve is required. Instead simple exposure of the can to the atmosphere is adequate and does not cause undue foaming or loss of carbonation in the product. The can is thereafter capped typically by a double sealing method as well understood in the prior art and passed to subsequent packaging and distribution stages.

It will be appreciated that the valve of the invention fulfills the needs of the art and objects of the invention listed above. Specifically, provision of a valve operated solely by the containers' pressing against a spring opened valve together with internal springs for complete control of the sequence of counterpressure and filling operations without interposition of externally operated cams or sequentially stepwise raised containers both simplifies the valve construction, rendering it less expensive and more foolproof of operation, and shortens the overall assembly to the point that the liquid tank need no longer be a pressure vessel. Furthermore, segregation of the liquid and counterpressure gas supply (as opposed to having both in a single tank) allows easy cleaning of the valve in place. One need simply substitute a simple cleaning adapter for the container to open the counterpressure valve and supply a pressurized detergent/water solution to the counterpressurizing gas manifold; the solution will flow through the cleaning adaptor, lift the product valve open, and flow out through the product manifold. Another advantage of the inventive valve construction is that the valve of the invention permits the bottle or can to move an appreciable distance after being sealed to the movable portion of the valve. This provides a better seal than valves in which the bottle or can simply is contacted against a seal member, and also renders the container height adjustment less critical, while allowing the volume of gas within the head space of the container after filling to expand before breaking the container/valve seal, thus rendering the snift operation much simpler and requiring less apparatus. Finally, the fact that the valve of the invention only opens when a container is present and correctly aligned provides an automatic failsafe means for preventing the valve from opening, thus preventing loss of product without requiring optical bottle or can presence sensors or the like.

Thus, there has been described an improved liquid filling valve and machine which is at once more simple to construct and operate than those in the prior art while being no less reliable, being less expensive and offering substantial advantages relating to the ability to be cleansed in place, to efficiency of operation and to ease of construction, by virtue of the compact valve structure which allows the liquid manifold not to be classed as a pressure vessel. While two preferred embodiments of the invention have been shown and described, those skilled in the art will recognize that modifications and improvements thereto are possible; accordingly, the above description of the invention should be considered as exemplary only and not a limitation on its scope, which is more properly defined by the following claims.

I claim:

1. Apparatus for the counterpressure filling of a container with a pressurized carbonated liquid comprising:

a first valve member;

means for moving said container to sealably engage the mouth of the container with said first movable valve member and to move said first movable valve member to admit counterpressure gas into said container;

a second valve member in communication with a reservoir of said pressurized liquid and normally held closed by the pressure of the liquid thereon and biased to open when the counterpressure within said container is substantially equal to the pressure of said carbonated liquid, whereby said second valve member opens after said container is counterpressurized, to admit said carbonated liquid into said container; and means for terminating flow of said carbonated liquid into said container at a predetermined point, wherein said means for moving said container relative to said valve member additionally removes said container from said valve means after termination of flow of said carbonated liquid into said container and closes said first and second valves.

2. The valve apparatus of claim 1 wherein said counterpressure gas and said carbonated liquid are supplied from separate sources.

3. The apparatus of claim 1 wherein said means for terminating flow of said carbonated liquid into said container comprises vent tube means having a passage therethrough for allowing removal of said counterpressure gas from said container, so that upon the level of said carbonated liquid reaching the uppermost inlet into sdaid vent tube, the flow of counterpressure gas out of and the flow of said carbonated liquid into said container is terminated.

4. A valve for the counterpressure filling of containers with carbonated products comprising:

a fixed portion and first, second and third movable portions, said first movable portion being adapted to be engaged with a container moved relative to said valve to form a seal with the mouth of said container, and to move said second movable portion so as to establish a passage for counterpressure gas to flow into said container, and said third movable portion being exposed to the counterpressure within said container and to pressure of said product on opposing surfaces thereof and ordinarily maintained in a closed position by the pressure of said product on one side thereof and biased to be opened in order to admit product into said container upon the forces exerted on said third movable member by said pressure and said counterpressure becoming substantially equal.

5. The valve of claim 4 wherein said second movable member comprises vent tube means for removal of counterpressurizing gas from said container upon admission of product thereto and for controlling the level within said container at which said product ceases to be admitted by closing the vent tube means for said counterpressure gas to be removed from said container.

6. The valve of claim 4 wherein said counterpressurizing gas and said product are supplied from independent sources.

7. Valve for the counterpressure filling of containers with carbonated liquids comprising first controllable valve means for admitting counterpressure gas from a first source;

means for bringing said container into sealing engagement with said valve means and for moving said container to open said first valve for admitting said compressed gas to said container;

second controllable valve means in communication on one side thereof with a supply of said liquid and on the other side with said container for admitting carbonated liquids to said container from a second source when opened;

bias means for opening said second valve means for admitting liquid to said container in response to counterpressurization within said container reaching a predetermined level; and means for terminating filling of said container with product after a predetermined level of product in the container has been reached.

8. The valve of claim 7 wherein pressure remaining in the head space of said container after filling is released by venting said head space to the atmosphere after filling, said venting being accomplished by uncovering a port in said second valve means.

9. The valve of claim 8 wherein said uncovering of said port is accomplished by removing said container from said valve permitting relative motion of plural portions of valve means so as to uncover said port to the atmosphere.

10. The valve of claim 7 wherein said second valve means is opened by said bias means when the force exerted on it by the counterpressure within said container to be filled is substantially equal to that exerted on it by said product.

11. In apparatus for the filling of containers with carbonated liquids of the type in which means are provided to move said containers individually into sealing engagement with valve means, the improvement which comprises:

said means for moving said containers into sealing engagement with said valve means also being means for opening a first movable valve means for admitting counter pressure gas to said container, said product being thereafter admitted into said container by opening of second movable valve means, said second movable valve means being adapted to be opened by bias means when the force exerted on said second valve means by the gas in said container is substantially equal to that exerted on it by said product.

12. A machine for the filling of containers with carbonated liquids comprising a plurality of valves adapted for individual sealing engagement with containers, means for receiving ones of said containers from a stream of said containers, said valves communicating with a reservoir of carbonated liquid and having counterpressure gas supplied thereto, first ones of said valves controlling counterpressurization of said containers, and second ones of said valves adapted to admit said carbonated liquid into said container when counterpressurization is completed;

means for sensing that the counterpressure in said container has reached a predetermined level and for opening said second valves to admit said carbonated liquid to said container when counterpressurization is completed; and means for sealingly engaging the mouths of said containers with said valves and for disengaging said containers from said valves after filling, wherein said means for sealingly engaging said containers with said valves also controls opening of said first valves initiating the sequence of counterpressurization and filling of said containers.

13. The machine of claim 12 wherein said means for sealingly engaging said containers with said valves controls opening of said first valves by moving said containers with respect to said first valves.

14. The machine of claim 12 wherein said means for sensing that the counterpressure within said container has reached a predetermined level comprises said second valves each comprising a movable member biased on one side by the pressure of said carbonated liquid and on the other by the counterpressure within said container, whereby when said counterpressure reaches a predetermined level, said valves open against the pressure of said carbonated liquid, permitting said carbonated liquid to flow into said container.

15. The machine of claim 14 wherein said second valve means is opened by bias means when said counterpressure reaches a predetermined fraction of the pressure of said carbonated liquid.

16. The machine of claim 15 wherein said predetermined fraction is controlled by the relative areas of portions of said second valve means exposed respectively to said counterpressure within said container and to the pressure of said carbonated liquid.

17. A valve for counterpressure filling of containers with carbonated liquids comprising:

a first stationary valve body member;

a first movable actuator;

first movable valve means for controlling flow of counterpressure gas into said container; and second movable valve means for controlling the flow of said carbonated liquid into said container, said first movable actuator being controlled to open said first valve means, and said second valve means being controlled to open when a predetermined counterpressure is reached within said container.

18. The valve of claim 17 wherein said first movable actuator, said first valve means and said second valve means are spring biased to remain at rest position until a container is pressed into sealing engagement with said first movable actuator.

19. The valve of claim 17 wherein said second valve means is adapted to be opened when force exerted on it by the counterpressure gas within said container is substantially equal to that exerted on it by said carbonated liquid.

20. The valve of claim 17 wherein said first valve means for controlling the flow of counterpressure gas into said container additionally comprises vent tube means for venting of said counterpressure gas from said container upon flow of said carbonated liquid into said container.

21. The valve of claim 17 wherein said container is a bottle and said bottle controls the motion of said first movable actutor portion with respect to said first valve means so as to uncover a snift port after filling of said bottle has been completed.

* * * * *